US005963175A

United States Patent [19]

Burr

[11] Patent Number: 5,963,175

[45] Date of Patent: Oct. 5, 1999

[54] ONE DIMENSIONAL INTERLEAVED MULTI-BEAM ANTENNA

[75] Inventor: Douglas G. Burr, San Jose, Calif.

[73] Assignee: CyberStar, L.P., Palo Alto, Calif.

[21] Appl. No.: 09/138,601

[22] Filed: Aug. 22, 1998

[51] Int. Cl.[6] ..... H01Q 19/14

[52] U.S. Cl. ..... 343/781 P; 343/DIG. 2; 343/779

[58] Field of Search ..... 343/781 P, 781 CA, 343/DIG. 2, 779

[56] References Cited

U.S. PATENT DOCUMENTS

| | | | |
|---|---|---|---|
| 4,343,005 | 8/1982 | Han et al. | 343/781 P |
| 4,407,001 | 9/1983 | Schmidt | 343/840 |
| 4,482,897 | 11/1984 | Dragone et al. | 343/779 |
| 5,373,302 | 12/1994 | Wu | 343/781 P |
| 5,402,137 | 3/1995 | Ramanujam et al. | 343/781 P |

*Primary Examiner*—Don Wong
*Assistant Examiner*—Shih-Chao Chen
*Attorney, Agent, or Firm*—Kenneth W. Float

[57] ABSTRACT

An efficient multi-beam antenna system for use with a high capacity communications satellite or spacecraft that maximizes frequency re-use of the allocated frequency spectrum. The antenna system has first and second offset reflectors disposed adjacent first and second sides of the spacecraft. A first plurality of the feed horns feed the first reflector, and a second plurality of the feed horns feed the second reflector. The feed horns and offset reflectors cooperate to produce a predetermined number of beams. Even numbered beams use a set of frequencies and polarizations that are orthogonal to a set of frequencies and polarizations used by odd numbered beams. The antenna beams are contiguous in one dimension.

11 Claims, 2 Drawing Sheets

ONE DIMENSIONAL INTERLEAVED MULTI-BEAM ANTENNA

BACKGROUND

The present invention relates generally to spacecraft communication systems, and more particularly, to a one-dimensional interleaved multi-beam antenna system for use in spacecraft communication systems.

The assignee of the present invention manufactures and deploys communication satellites. In order to provide desired coverage of a particular area on the Earth, and maximize re-use of the allocated frequency spectrum, it is necessary to use an interleaved multi-beam antenna system.

Conventional multi-beam antenna systems typically localize antenna beams on a two dimensional triangular or rectangular lattice. Conventional reflector or lens multi-beam antenna systems generally require the use of three or four apertures to efficiently achieve the desired coverage. Furthermore, the bandwidth for each beam produced by conventional multi-beam antennas and useable in a frequency re-use plan is generally less that would be desired.

It would therefore be desirable to have a multi-beam antenna system for use with a communications satellite that maximizes frequency re-use of the allocated frequency spectrum. Accordingly, it is an objective of the present invention to provide for an improved one-dimensional interleaved multi-beam antenna system for use in spacecraft communication systems.

SUMMARY OF THE INVENTION

To accomplish the above and other objectives, the present invention provides for an efficient multi-beam antenna system for use with a high capacity communications satellite that maximizes frequency re-use of the allocated frequency spectrum. The antenna system comprises first and second offset reflectors that are disposed adjacent first and second sides of the spacecraft. A first plurality of the feed horns feed the first reflector, and a second plurality of the feed horns feed the second reflector. The feed horns and first and second offset reflectors cooperate to produce a predetermined number of beams. Even numbered beams use a set of frequencies and polarizations that are orthogonal to a set of frequencies and polarizations used by odd numbered beams. The antenna beams are contiguous in one dimension.

The antenna system thus generates antenna beams that are contiguous in one dimension as opposed to localizing them on a two dimensional triangular or rectangular lattice as in conventional antenna systems. The antenna system also incorporates a frequency and polarization re-use plan that allows the use of non-contiguous output multiplexers.

The design of the antenna system requires fewer apertures (2 instead of 4, for example) for the same spillover loss compared to a conventional reflector or lens multi-beam antenna system. The antenna system also provides twice the bandwidth per beam (produced by a conventional multi-beam antenna system with a 4 sub-band frequency re-use pattern) while producing equivalent or better beam to beam isolation.

The choice of the type and number of antenna apertures are not limited. Antenna systems may be readily designed using the principles of the present invention that employ a single multi-beam phased array to achieve similar coverage.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
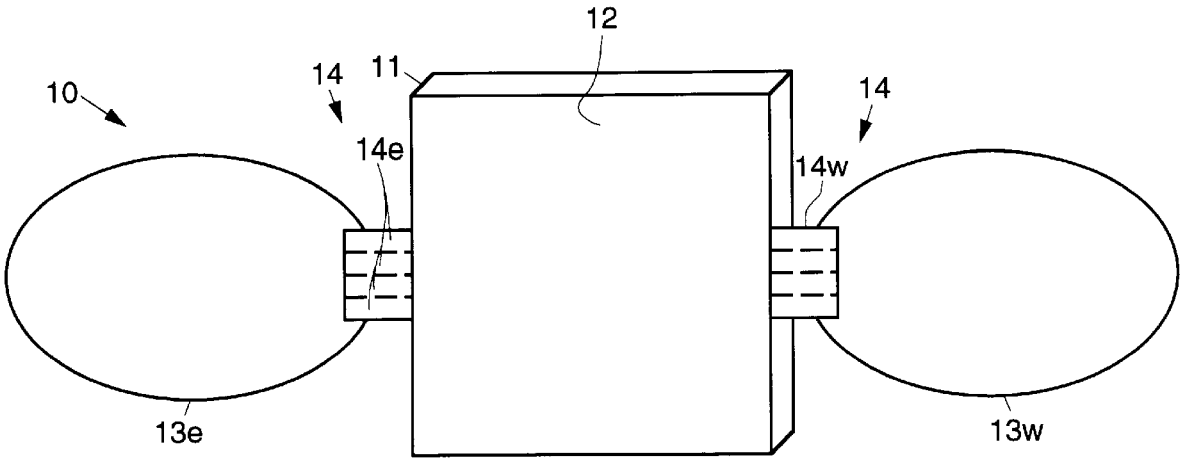
FIG. 1 illustrates a typical spacecraft employing an antenna system in accordance with the principles of the present invention.
Figure 2:
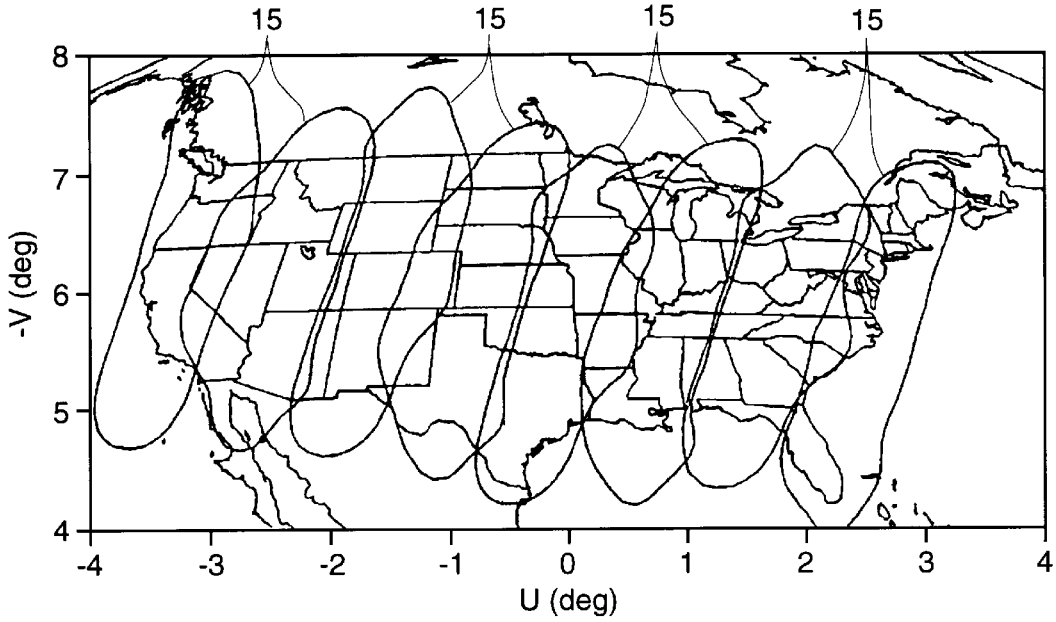
FIG. 2 illustrates directivity contours produced by optimized shaped reflectors used in an exemplary embodiment of the present antenna system.

Referring to the drawing figures, FIG. 1 illustrates a typical spacecraft 11 employing an antenna system 10 in accordance with the principles of the present invention. The spacecraft 11 is shown having its nadir face 12 pointing in the direction of coverage beams 15 (FIG. 2) produced by the antenna system 10, namely toward the Earth, and in particular the United States, for example, as is illustrated in FIG. 2. The antenna system 10 comprises two offset reflectors 13*e*, 13*w* that are disposed adjacent east and west sides of the spacecraft 11. The antenna system 10 further comprises a predetermined even number (eight) of feed horns 14, including first and second pluralities (four) of feed horns 14*e*, 14*w* that respectively feed each of the reflectors 13*e*, 13*w*. The antenna beams 15 generated by the antenna system 10 are contiguous in one dimension.

In an exemplary embodiment, the antenna system 10 includes two relatively large (3.5 by 2.4 meter) shaped offset reflectors 13*e*, 13*w* operated in the Ku FSS band (12 GHz). The four feed horns 14 for each reflector 13*e*, 13*w* are aligned to produce 8 beams 15 numbered 1 to 8 from west to east as shown in FIG. 2. The west reflector 13*w* produces odd numbered beams 15 while the east reflector 13*e* produces even numbered beams 15. The antenna beams 15 generated by the antenna system 10 are contiguous in one dimension, as is shown in FIG. 2.

Figure 3:
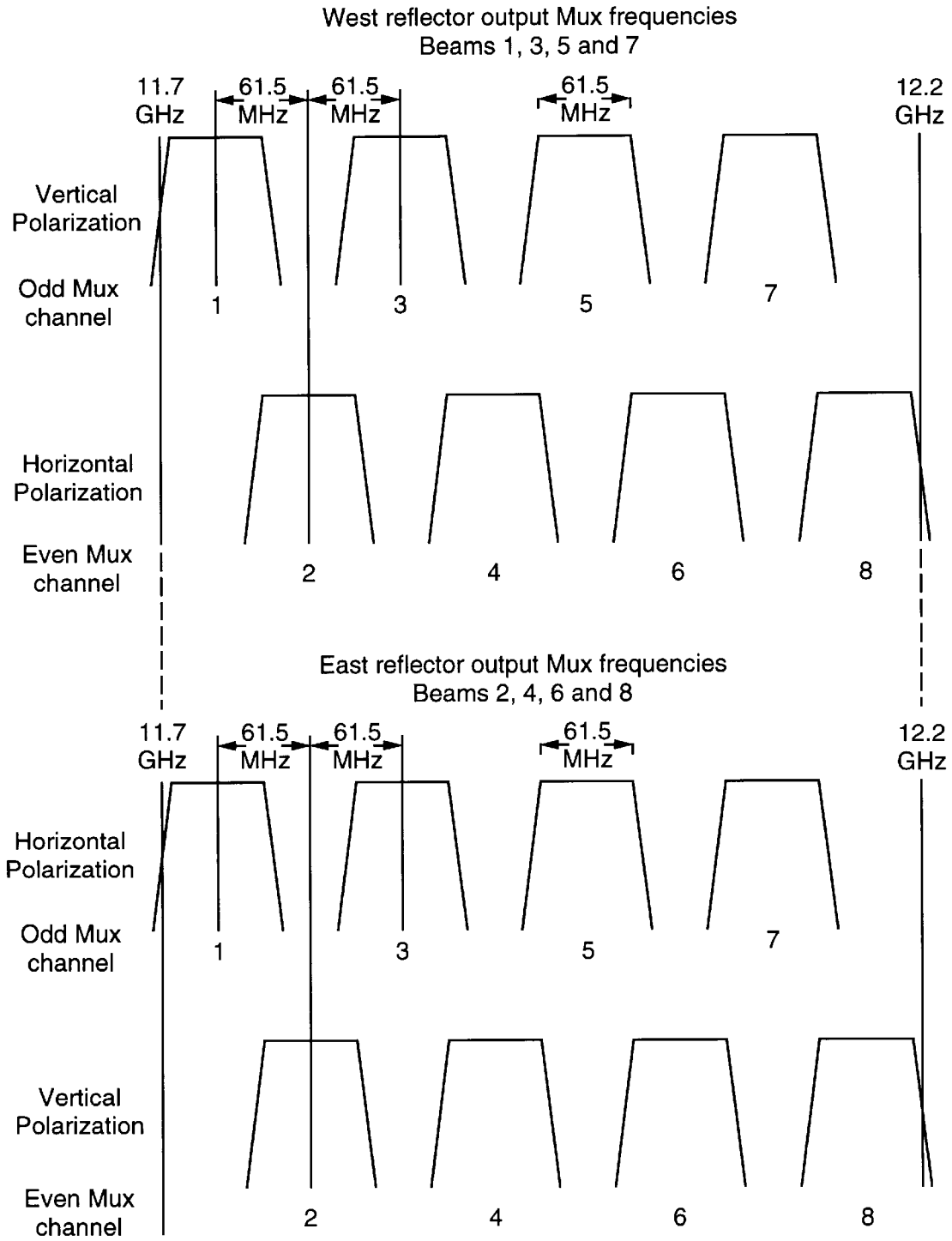
FIG. 3 illustrates a sample frequency plan for an exemplary embodiment of the present antenna system.

More particularly, FIG. 2 shows 38.25 dB directivity contours produced by optimized shaped reflectors 13*e*, 13*w* used in an exemplary embodiment of the antenna system 10. The directivity contours are configured to completely cover the United States in the manner shown in FIG. 2. Each odd numbered beam 15 uses the same frequencies and polarizations. The even numbered beams 15 use a set of frequencies and polarizations that are orthogonal to those used by the odd numbered beams 15. The net frequency re-use factor is equal to the number of beams 15, in this case 8. FIG. 3 shows a sample frequency plan for an exemplary embodiment of the antenna system 10 used to provide coverage of the United States as shown in FIG. 2.

It is to be understood that the number of beams produced by the present invention is not limited to 8 as is disclosed in the exemplary embodiment. The antenna system 10 may produce different numbers of beam suitable for different applications. For example, antenna systems 10 may be readily designed that use 12 beams, for example. Furthermore, the frequency plan and frequency band may be different from those used in the disclosed exemplary embodiment, and the present invention is not limited to any particular operating frequency band. In particular, the concepts of the present invention may be used to produce antenna systems 10 that operate in the S, C, X, Ku, K, Ka, Q, V, or W frequency bands, for example, or other desired frequency band as the application requires. It is to be understood that what is significant with regard to practicing the present invention is that adjacent beams use two different polarization and frequency plans irrespective of the number of beams or operating frequency band.

It is to be understood that the choice of the type and the number of antenna apertures are not limited to those chosen in the exemplary embodiment. For example, antenna systems may be readily designed that employ a single multibeam phased array to achieve similar coverage.

Thus, an improved one-dimensional interleaved multibeam antenna system for use in spacecraft communication systems has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. An antenna system for use on a spacecraft, comprising:

first and second offset reflectors disposed adjacent first and second sides of the spacecraft;

a predetermined number of feed horns, comprising a first plurality of feed horns that feed the first reflector, and a second plurality of feed horns that feed the second reflector;

the feed horns and first and second offset reflectors cooperating to produce a predetermined number of beams that are contiguous in one dimension;

and wherein even numbered beams use a set of frequencies and polarizations that are orthogonal to a set of frequencies and polarizations used by odd numbered beams.

2. The antenna system recited in claim 1 wherein the offset reflectors each have a predetermined shape that provides a predetermined coverage area for each of the respective beams.

3. The antenna system recited in claim 1 wherein the feed horns and offset reflectors are designed to operate in the Ku FSS band.

4. The antenna system recited in claim 1 wherein the predetermined number of feed horns comprise eight feed horns, including four feed horns that respectively feed each of the reflectors.

5. The antenna system recited in claim 1 wherein the first plurality of feed horns and first reflector produce even numbered beams and the second plurality of feed horns and second reflector produce odd numbered beams.

6. The antenna system recited in claim 1 wherein the feed horns and offset reflectors are designed to operate in a frequency band selected from the group including the S, C, X, Ku, K, Ka, Q, V, or W frequency bands.

7. An antenna system for use on a spacecraft, comprising:

first and second offset reflectors disposed adjacent first and second sides of the spacecraft;

eight feed horns, four of which feed the first reflector, and four of which feed the second reflector;

the feed horns and first and second offset reflectors cooperating to produce eight beams that are contiguous in one dimension;

and wherein even numbered beams use a set of frequencies and polarizations that are orthogonal to a set of frequencies and polarizations used by odd numbered beams.

8. The antenna system recited in claim 7 wherein the offset reflectors each have a predetermined shape that provides a predetermined coverage area for each of the respective beams.

9. The antenna system recited in claim 7 wherein the feed horns and offset reflectors are designed to operate in the Ku FSS band.

10. The antenna system recited in claim 7 wherein the feed horns and the first reflector fed thereby produce even numbered beams, and wherein the feed horns and the second reflector fed thereby produce odd numbered beams.

11. The antenna system recited in claim 7 wherein the feed horns and offset reflectors are designed to operate in a frequency band selected from the group including the S, C, X, Ku, K, Ka, Q, V, or W frequency bands.

* * * * *